US011026479B2

(12) United States Patent
Schnedler

(10) Patent No.: US 11,026,479 B2
(45) Date of Patent: Jun. 8, 2021

(54) SYSTEMS, DEVICES, AND/OR METHODS FOR MANAGING SHOES

(71) Applicant: Leighton Schnedler, Charlottesville, VA (US)

(72) Inventor: Leighton Schnedler, Charlottesville, VA (US)

( * ) Notice: Subject to any disclaimer, the term of this patent is extended or adjusted under 35 U.S.C. 154(b) by 0 days.

(21) Appl. No.: 16/588,724

(22) Filed: Sep. 30, 2019

(65) Prior Publication Data

US 2021/0093047 A1 Apr. 1, 2021

(51) Int. Cl.
*A43C 7/00* (2006.01)
*A43C 11/16* (2006.01)

(52) U.S. Cl.
CPC ..... *A43C 7/00* (2013.01); *A43C 11/165* (2013.01)

(58) Field of Classification Search
CPC ..... A43C 7/00; A43C 11/165
See application file for complete search history.

(56) References Cited

U.S. PATENT DOCUMENTS

| | | | | |
|---|---|---|---|---|
| 2,893,090 | A * | 7/1959 | Pagoda | A43C 7/00 24/712.2 |
| 2010/0101061 | A1* | 4/2010 | Ha | A43C 7/00 24/712.5 |
| 2014/0290014 | A1* | 10/2014 | Myrick | A43C 11/165 24/712.2 |
| 2015/0007422 | A1* | 1/2015 | Cavanagh | A43C 11/165 24/68 SK |
| 2017/0027287 | A1* | 2/2017 | Burns | A43C 11/165 |
| 2018/0132567 | A1* | 5/2018 | Lee | A43C 11/20 |
| 2020/0268108 | A1* | 8/2020 | Fiedler | A43C 11/165 |

* cited by examiner

*Primary Examiner* — Robert Sandy
*Assistant Examiner* — David M Upchurch
(74) *Attorney, Agent, or Firm* — Dale Jensen, PLC; Dale Jensen

(57) ABSTRACT

The application discloses a tightening system for shoelaces. The tightening system contains a tightener inset in the body of a shoe, a hinge coupled to a tightener, an appendage coupled to the tightener via the hinge, in which the appendage can go in and out of the body of the shoe via the hinge so that it can be inset in the rear body of the shoe and not protruding when the user is not loosening or tightening the shoelaces, and the appendage can protrude from the shoe when not secured into place so that a user can use the appendage to engage with each of the pair of shoelaces; and responsive to an action of a user, cause each of the pair of shoelaces to be loosened and tightened.

16 Claims, 4 Drawing Sheets

SYSTEMS, DEVICES, AND/OR METHODS FOR MANAGING SHOES

BRIEF DESCRIPTION OF THE DRAWINGS

A wide variety of potential practical and useful embodiments will be more readily understood through the following detailed description of certain exemplary embodiments, with reference to the accompanying exemplary drawings in which.

DETAILED DESCRIPTION

Certain exemplary embodiments provide a tightening system for a shoe. The shoe comprises a body. The body defines a plurality of eyelets. The shoe is engageable with a pair of shoelaces. Each of the pair of shoelaces constructed to engage with a set of the plurality of eyelets. The shoe comprises a tightener. The tightener is constructed to, responsive to an action of a user, cause each of the pair of shoelaces to be loosened and tightened.

Certain exemplary embodiments provide for improved shoes wherein a user can more easily adjust lace tightness quickly and efficiently.

Figure 1:
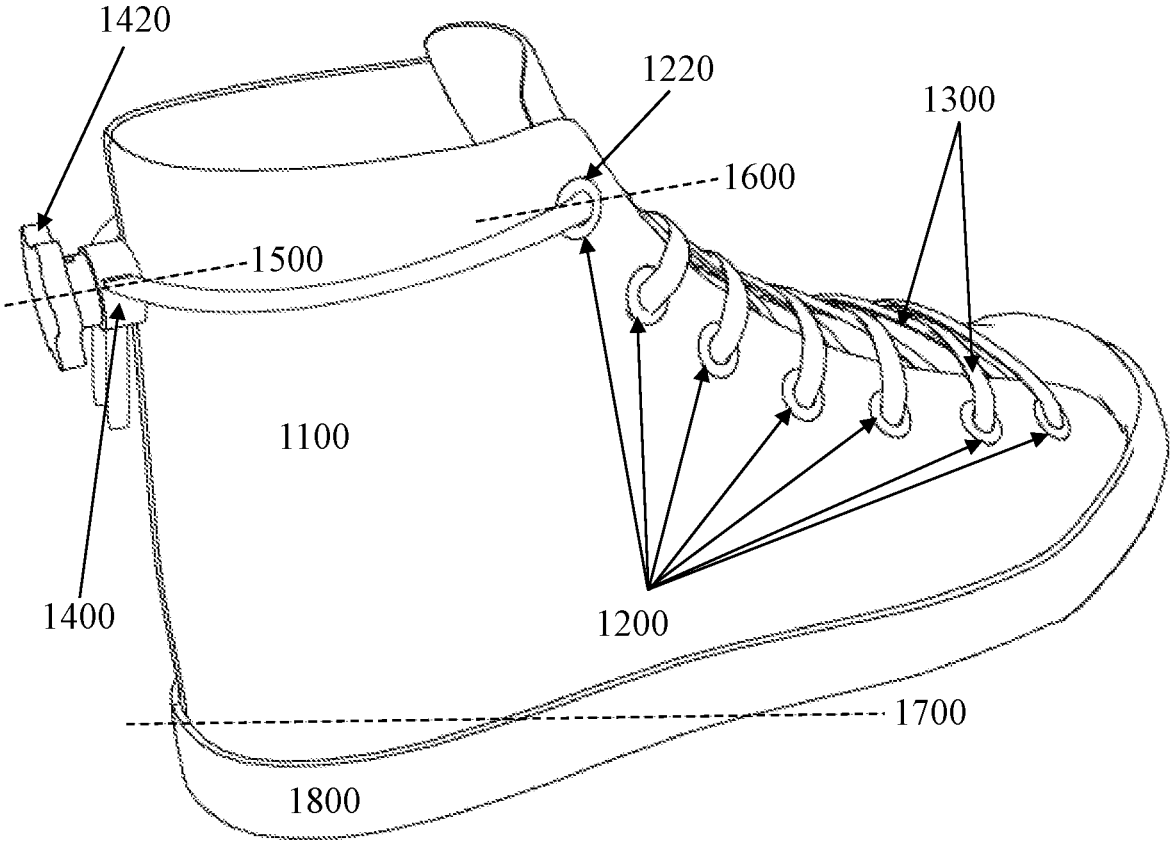
FIG. 1 is a perspective view of an exemplary embodiment of a shoe 1000.

FIG. 1 is a perspective view of an exemplary embodiment of a shoe 1000, which can comprise a body 1100. Body 1100 defines a plurality of eyelets 1200. Each of plurality of eyelets 1200 is engageable with a pair of shoelaces 1300. Each of pair of shoelaces 1300 is constructed to engage with a set of plurality of eyelets 1200.

Shoe 1000 comprises a tightener 1400. Tightener 1400 is coupled to a rear portion of body 1100. In certain exemplary embodiments, a centerline 1500 of tightener 1400 is at an elevation on the rear portion of shoe 1000 that is approximately a same elevation as a centerline 1600 of an uppermost eyelet 1220 of the plurality of eyelets. In other embodiments, a centerline 1500 of tightener 1400 can be at an elevation on the rear portion of the shoe that is above an uppermost elevation 1700 of a sole 1800 of shoe 1000. In certain exemplary embodiments, tightener 1400 can be coupled to an upper portion of body 1100, a centerline 1500 of tightener 1400 at an elevation on the shoe that is above uppermost elevation 1700 of sole 1800 of shoe 1000.

Tightener 1400 may be moved higher or lower on the rear portion of shoe 1000. Tightener 1400 can be constructed to:

- engage with each of pair of shoelaces 1300; and/or
- responsive to an action of a user, cause each of pair of shoelaces 1300 to be loosened and tightened.

In the illustrated embodiment, tightener 1400 comprises a wheel 1420 that is able to be turned by the user to loosen and tighten each of pair of shoelaces 1300.

In certain exemplary embodiments, tightener 1400 comprises wheel 1420 to which pair of shoelaces 1300 is coupled such that pair of shoelaces 1300 wraps around tightener 1400 when the user tightens pair of shoelaces 1300 to and unwraps around tightener 1400 when the user loosens pair of shoelaces 1300.

In certain exemplary embodiments, tightener 1400 can be positioned in other locations on shoe 1000, such as on a side of shoe 1000.

In certain exemplary embodiments, no laces would run around an outside of the rear of shoe 1000. When one isn't loosening or tightening shoe 1000 with an appendage coming off of tightener 1400, such shoes can look like a shoe lacking tightener 1400 because an entirety of tightener 1400 is inset in the shoe. When the appendage is secured into place (and a wheel inset), only one side of the appendage would be viewable from the back, and an observer wouldn't see tightener 1400 when viewing the shoe from the sides or the front because nothing would protrude from body 1100 of shoe 1000.

The appendage can be on a hinge that couples it to a wheel, which would allow the appendage to be inset in the rear portion of body 1100 and would also allow the appendage to protrude when one wants to tighten or loosen the shoe.

Figure 2:
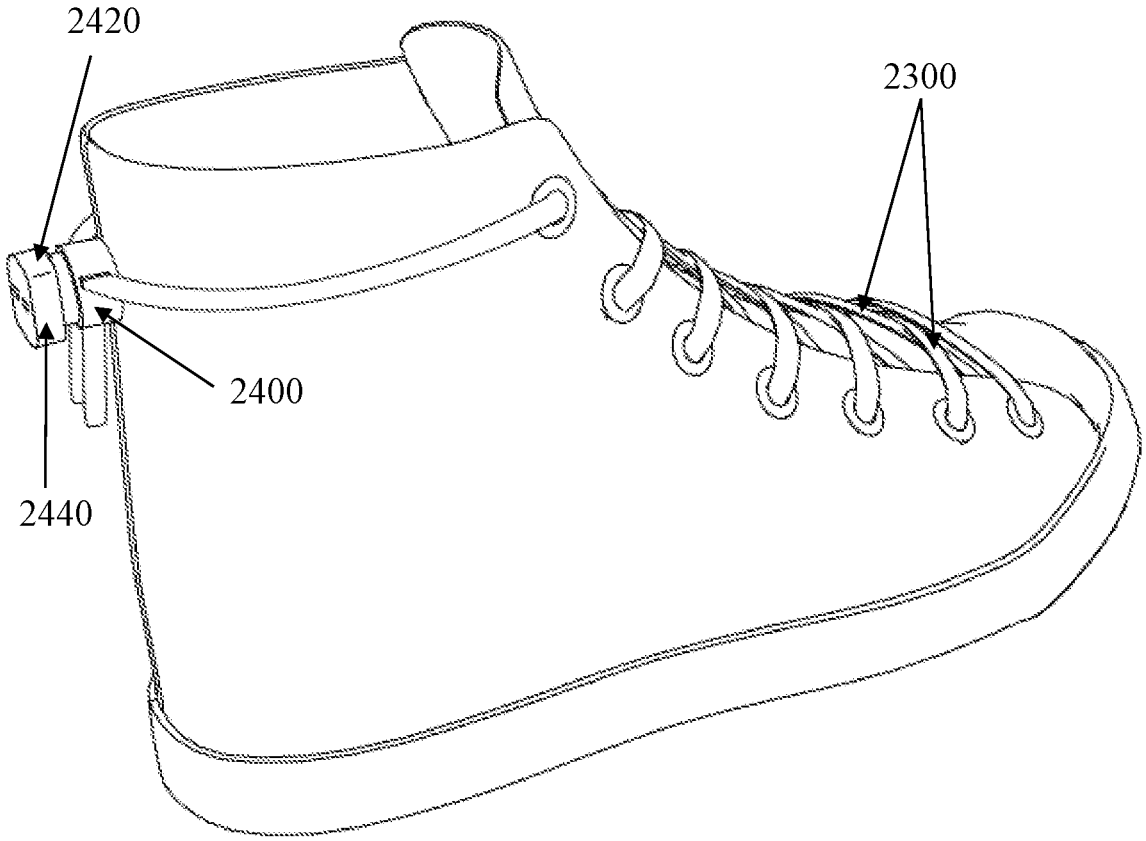
FIG. 2 is a perspective view of an exemplary embodiment of a shoe 2000.

FIG. 2 is a perspective view of an exemplary embodiment of a shoe 2000, which can comprise a pair of shoelaces 2300 and a tightener 2400. In the illustrated embodiment, tightener 2400 comprises an electrical actuator 2420 operable by the user to loosen and tighten each of pair of shoelaces 2300. In certain exemplary embodiments, electrical actuator 2420 can be operable by pushing or pulling on an exposed portion of electrical actuator 2420. In certain exemplary embodiments, electrical actuator 2420 can be operable by rotating on an exposed portion of electrical actuator 2420, with loosening or tightening selected by a rotational position of the exposed portion of electrical actuator 2420. Electrical actuator 2420 can be moved up or down the rear of shoe 2000 as desired.

Tightener 1400 as shown in FIG. 1 or tightener 2400 as shown in FIG. 2 may be exposed and or may be partially or completely inset in the rear body of shoe 1000 and shoe 2000, respectively.

For example, when tightener 1400 is inset, an appendage could be added that would be the only protruding element from body 1100. This appendage would be turned, causing tightener 1400 to turn, causing the shoelaces to move. The appendage could also be on a hinge that couples it to wheel 1420, which would allow the appendage to be inset in the rear portion of body 1100 and would also allow the appendage to protrude when one wanted to tighten or loosen the shoe. When the appendage is inset in the rear portion of body 1100, a securing mechanism could be used to secure the appendage in place so that nothing or very little is protruding from the rear of body 1100. In such embodiments, different shapes of objects can be used as the appendage. For example, an anchor-shaped appendage could be used in which the crown of the anchor would be the part that protrudes from the shoe and the head couples to the hinge. In this example, the crown of the anchor would be that part that a user turns to tighten the shoe. When secured into position, the crown would no longer be protruding from the rear of body 1100, but one could see the shape of the inset anchor when viewing the shoe from the rear. A variety of objects could be used as the appendage, so long as the part protruding from the shoe had enough surface area so that one was able to grip the part that could protrude in order to turn it and tighten the shoe. A similar appendage 2440 could be used for tightener 2400 and shoe 2000. Although tightener 2400 is not illustrated as inset in FIG. 2, those skilled in the art will recognize that shoe 2000 can be constructed in a manner in which tightener 2400 is inset in shoe 2000.

In certain exemplary embodiments of Shoe 1000, tightener 1400 could be spring-loaded so that someone putting on the shoe would get close to the appropriate level of tightness when they put on the shoe, because the spring will tighten it to the foot. One could then they could make a small adjustment to get the level of tightness where they want it by turning the appendage or by turning wheel 1420 in embodiments lacking an appendage.

In certain exemplary embodiments of Shoe 1000, tightener 1400 could be located in the rear of the sole of the shoe (e.g., substantially at a heel of the shoe), so as to allow a typically harder material used in soles to serve as a strong location to hold tightener 1400.

Figure 3:
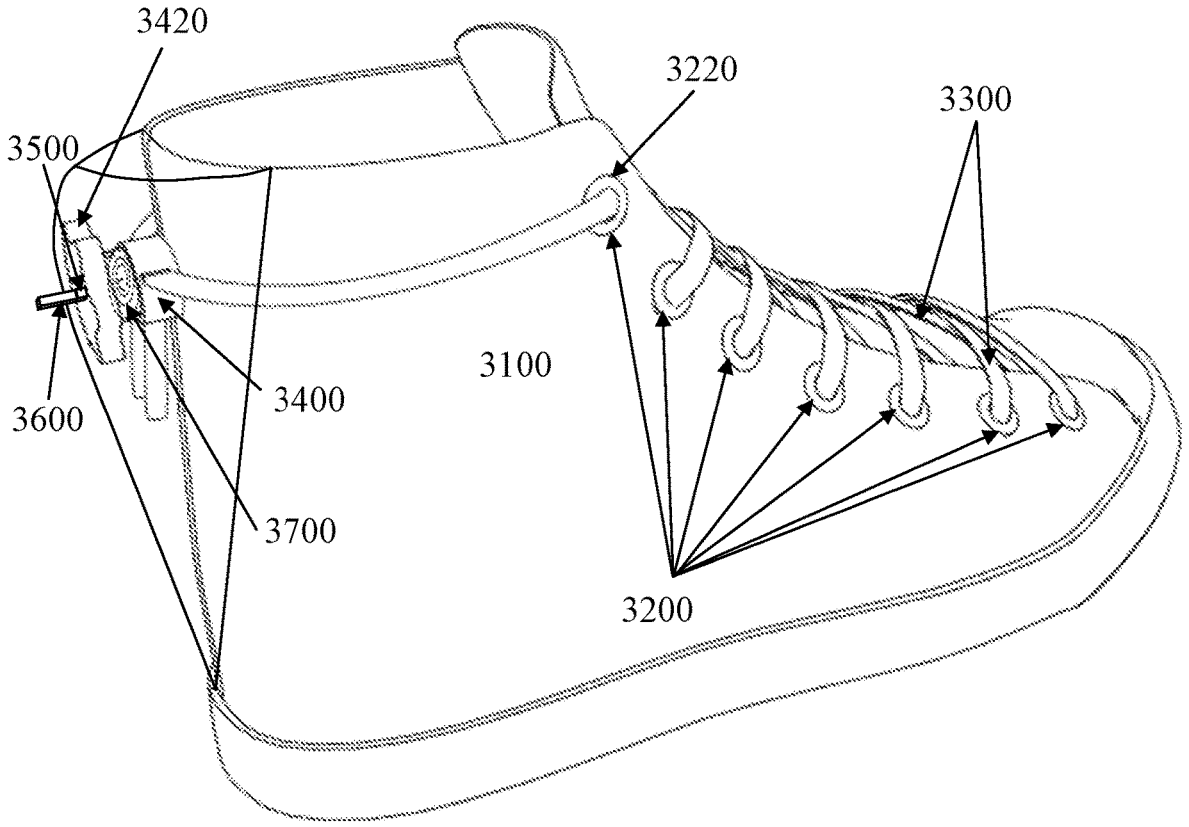
FIG. 3 is a perspective view of an exemplary embodiment of a shoe 3000.

FIG. 3 is a perspective view of an exemplary embodiment of a shoe 3000, which can comprise a body 3100. Body 3100 defines a plurality of eyelets 3200. Each of plurality of eyelets 3200 is engageable with a pair of shoelaces 3300. Each of pair of shoelaces 3300 is constructed to engage with a set of plurality of eyelets 3200.

Shoe 3000 comprises a tightener 3400, which as illustrated is inset in shoe 3000. Tightener 3400 comprises a hinge 3500, an appendage 3600, and a spring 3700. In the illustrated embodiment, tightener 3400 is turned via appendage 3600. In certain exemplary embodiments, appendage 3600 can be constructed such that it can be gripped and turned directly by a hand of a user. In other embodiments, a tool can be provided to the user that is coupleable to appendage 3600 to turn tightener 3400 such that pair of shoelaces 3300 are loosened or tightened. Tightener 3400 can be spring loaded via spring 3700. Spring 3700 can be biased to either loosen or tighten shoe 3000 responsive to an action of the user (e.g., putting the shoe on, putting pressure on appendage 3600, etc.).

In certain exemplary embodiments, tightener 3400 is spring loaded so that it tightens to a foot when one puts shoe 3000 on.

In certain exemplary embodiments, shoelaces 3300 enter the body of shoe 3000 at topmost eyelet 3220 so that shoelaces 3300 go around the rear of shoe 3000 inside the body of shoe 3000 instead of around the outside of shoe 3000, thus reaching the inset tightener 3400.

In certain exemplary embodiments, appendage 3600 is coupled to wheel 3420 via hinge 3500, wherein appendage 3600 can be turned, which will turn a wheel 3420 that engages tightener 3400, which will tighten or loosen pair of shoelaces 3300.

In certain exemplary embodiments, appendage 3600 is coupled directly to tightener 3400 via hinge 3500, and there is no wheel 3420. In this instance, turning appendage 3600 engages tightener 3400 to tighten the laces. In certain exemplary embodiments, tightener 3400 is a wheel itself such that the laces wrap around tightener 3400 when appendage 3600 is turned.

Figure 4:
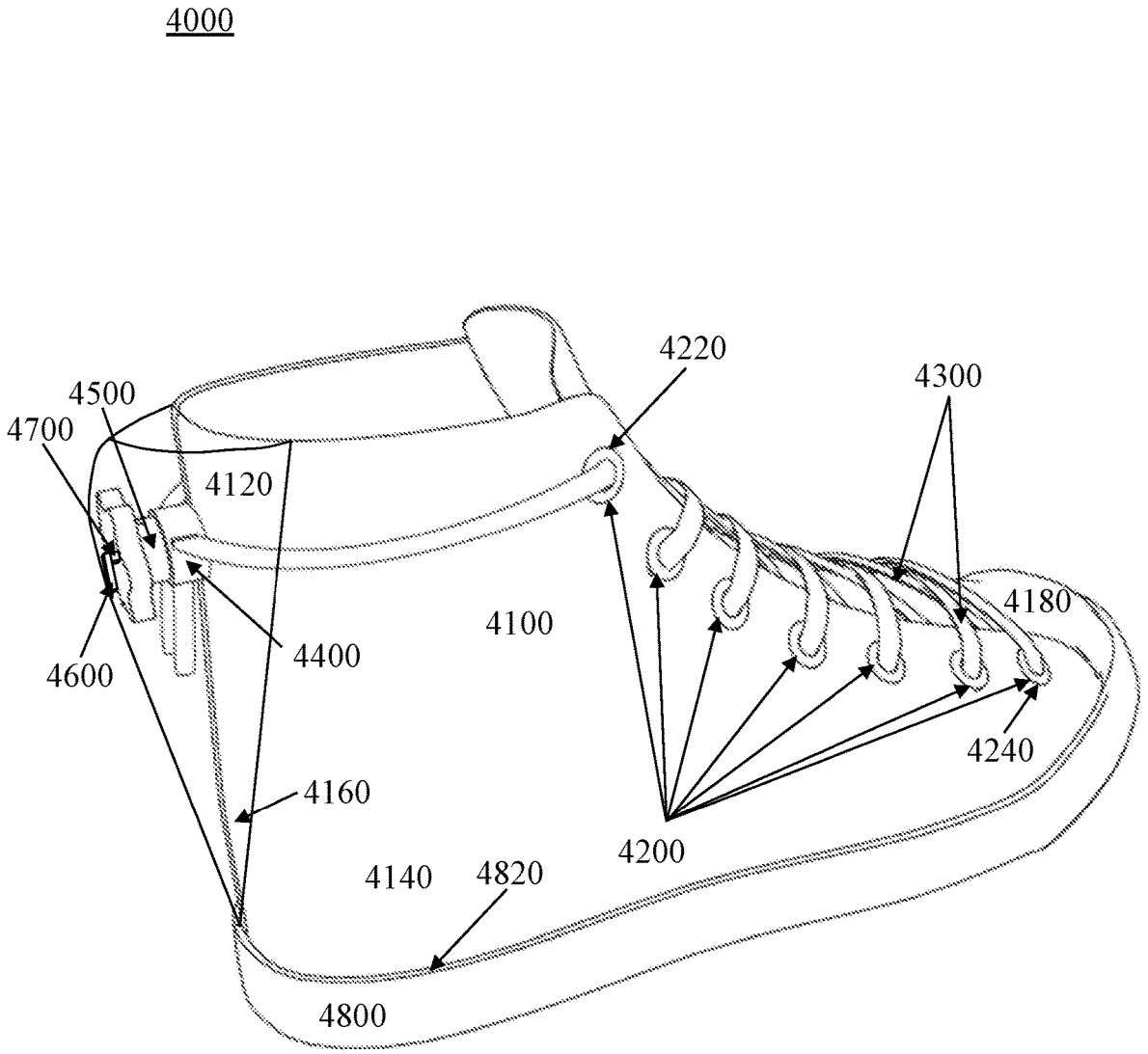
FIG. 4 is a perspective view of an exemplary embodiment of a shoe 4000.

FIG. 4 is a perspective view of an exemplary embodiment of a shoe 4000, which can comprise a body 4100. Body 4100 defines a plurality of eyelets 4200. Each of plurality of eyelets 4200 is engageable with a pair of shoelaces 4300. Each of pair of shoelaces 4300 is constructed to engage with a set of plurality of eyelets 4200.

Shoe 4000 comprises a tightener 4400, which as illustrated is inset in shoe 4000. Tightener 4400 comprises a hinge 4500, an appendage 4600, and a spring. In the illustrated embodiment, appendage 4600 is in a secured position at which tightener 4400 is not adjustable.

In certain exemplary embodiments, appendage 4600 is coupled directly to tightener 4400 via hinge 4500, and there is no wheel 4420. In this instance, turning appendage 4600 engages tightener 4400 to tighten the laces. In some instances, tightener 4400 may be a wheel itself such that the laces wrap around tightener 4400 when appendage 4600 is turned.

In certain exemplary embodiments, shoelaces 4300 enter the body of shoe 4000 at topmost eyelet 4220 so that shoelaces 4300 go around the rear of shoe 4000 inside the body of shoe 4000 instead of around the outside of shoe 4000, thus reaching the inset tightener 4400.

Certain exemplary embodiments comprise:

- tightener 4400, which is inset in body 4100 of shoe 4000;
- hinge 4500, which is coupled to tightener 4400; and
- appendage 4600, which is coupled to tightener 4400 via hinge 4500, wherein appendage 4600 constructed to move in and out of body 4100 of shoe 4000 such that appendage 4600 can be inset in body 4100 of shoe 4000, secured into place, and thus not protrude when a user is not loosening or tightening pair of shoelaces 4300, wherein appendage 4600 can protrude from shoe 4000 when appendage 4600 is not secured into place so that the user can use appendage 4600 to:
  - engage tightener 4400 which engages with each of pair of shoelaces 4300; and
  - responsive to an action of the user, cause each of pair of shoelaces 4300 to be loosened and tightened.

A securing mechanism 4700 can keep appendage 4600 from protruding from shoe 4000 such that appendage 4600 is biased to stay inside body 4100 of shoe 4000, but the user can pull on appendage 4600 to cause appendage 4600 to protrude from shoe 4000 so the user can use appendage 4600 to operate tightener 4400. Securing mechanism 4700 can comprise a spring and/or a magnet. In embodiments where securing mechanism 4700 is a magnet, the magnet can be inset in shoe 4000 and attract a metal part of appendage 4600. In certain exemplary embodiments, the magnet has a strong enough magnetic field to keep appendage 4600 in shoe 4000 when the user is not loosening or tightening shoe 4000, but a weak enough magnetic field so that a user can easily pull appendage 4600 out of a secured position to adjust tightness of shoe 4000.

In certain exemplary embodiments, pair of shoelaces 4300 enters into body 4100 of shoe 4000 at a topmost eyelet 4220 and goes through a rear portion 4120 of body 4100 of shoe 4000 to reach tightener 4400. In certain exemplary embodiments, pair of shoelaces 4300 enters into body 4100 of shoe 4000 at a bottommost eyelet 4240 and goes through a side portion 4140 and rear portion 4120 of body 4100 of shoe 4000 to reach tightener 4400.

In certain exemplary embodiments, tightener 4400 is inset in rear portion 4120 of body 4100, a centerline of tightener 4400 (see, e.g, centerline 1500 of FIG. 1) at an elevation on rear portion 4120 of shoe 4000 that is above an uppermost portion 4820 of a sole 4800 of shoe 4000. In certain exemplary embodiments, tightener 4400 is inset in a lower portion 4160 of rear portion 4120 of body 4100 of shoe 1000, a centerline (see, e.g, centerline 1500 of FIG. 1) of tightener 4400 at an elevation on rear portion 4120 of shoe 4000 that is in line with sole 4800 of shoe 4000. In certain exemplary embodiments, tightener 4400 is inset in side portion 4140 of body 4100 of shoe 4000. In other exemplary embodiments, tightener 4400 is inset in of front portion 4180 of body 4100 of shoe 4000.

In certain exemplary embodiments, appendage 4600 comprises a wheel constructed to be turned by the user to loosen and tighten each of pair of shoelaces 4300. Appendage 4600 is coupled to an object, such as a wheel, which is coupled to tightener 4400 and engages tightener 4400 when appendage 4600 is engaged.

In certain exemplary embodiments, tightener 4400 that is not entirely inset in body 4100 of shoe 4000. In certain exemplary embodiments, appendage 4600 is also always protruding from body 4100 of shoe 4000.

Definitions

When the following terms are used substantively herein, the accompanying definitions apply. These terms and definitions are presented without prejudice, and, consistent with the application, the right to redefine these terms during the prosecution of this application or any application claiming priority hereto is reserved. For the purpose of interpreting a claim of any patent that claims priority hereto, each definition (or redefined term if an original definition was amended during the prosecution of that patent), functions as a clear and unambiguous disavowal of the subject matter outside of that definition.

a—at least one.
able—capable of being.
activity—an action, act, step, and/or process or portion thereof
action—a process of doing something.
actuator—a device that uses electrical energy to produce a force that causes a reciprocating motion.
adapter—a device used to effect operative compatibility between different parts of one or more pieces of an apparatus or system.
and/or—either in conjunction with or in alternative to.
apparatus—an appliance or device for a particular purpose.
appendage—a projecting part.
associate—to join, connect together, and/or relate.
body—a largest or principal part of an object.
can—is capable of, in at least some embodiments.
cause—to produce an effect.
centerline—a line through a center of something following an axis of symmetry.
circuit—an electrically conductive pathway and/or a communications connection established across two or more switching devices comprised by a network and between corresponding end systems connected to, but not comprised by the network.
comprising—including but not limited to.
configure—to make suitable or fit for a specific use or situation.
connect—to join or fasten together.
constructed to—made to and/or designed to.
convert—to transform, adapt, and/or change.
couple—to link in some fashion.
create—to bring into being.
define—to establish the outline, form, or structure of
determine—to obtain, calculate, decide, deduce, and/or ascertain.
device—a machine, manufacture, and/or collection thereof.
electrical—powered by electricity.
elevation—a height above a given level.
engage—to be in contact and interact with.
eyelet—an aperture constructed to receive a shoelace.
generate—to create, produce, give rise to, and/or bring into existence.
hinge—a mechanical bearing that connects two components, which allows rotation between the two components.
initialize—to prepare something for use and/or some future event.
inset—to be inserted within something else in such a way as to be recessed substantially below a surface.
install—to connect or set in position and prepare for use.
loosen—make shoelaces less tight.
may—is allowed and/or permitted to, in at least some embodiments.
method—a process, procedure, and/or collection of related activities for accomplishing something.
move—to go or pass to another place or in a certain direction.
operable—capable of functioning.
pair—two similar things used together.
plurality—the state of being plural and/or more than one.
portion—a part of a whole.
predetermined—established in advance.
provide—to furnish, supply, give, and/or make available.
rear—a back of something.
receive—to get, take, acquire, and/or obtain.
repeatedly—again and again; repetitively.
request—to express a desire for and/or ask for.
responsive—reacting to an influence and/or impetus.
secure—to firmly couple something.
select—to make a choice or selection from alternatives.
set—a related plurality.
shoe—an outer covering for the human foot.
shoelaces—a cord constructed to be passed through eyelets on opposite sides of a shoe and pulled tight and/or fastened.
sole—a bottom portion of a shoe of which a lowest portion contacts walking surfaces when the shoe is worn.
spring loaded—comprising a compressed or stretched spring pressing one part against another.
store—to place, hold, and/or retain.
substantially—to a great extent or degree.
support—to bear the weight of, especially from below.
system—a collection of mechanisms, devices, machines, articles of manufacture, processes, data, and/or instructions, the collection designed to perform one or more specific functions.
tighten—make shoelaces more tight.
tightener—a device constructed to tighten and loosen shoelaces.
transmit—to send, provide, furnish, and/or supply.
turn—to change a position of by traversing an arc.
uppermost—highest in elevation.
user—any person that uses a device.
via—by way of and/or utilizing.
weight—a value indicative of mass.
wheel—a solid disk or a rigid circular ring connected by spokes to a hub, designed to turn around an axle passed through the center.

Note

Still other substantially and specifically practical and useful embodiments will become readily apparent to those skilled in this art from reading the above-recited and/or herein-included detailed description and/or drawings of certain exemplary embodiments. It should be understood that numerous variations, modifications, and additional embodiments are possible, and accordingly, all such variations, modifications, and embodiments are to be regarded as being within the scope of this application.

Thus, regardless of the content of any portion (e.g., title, field, background, summary, description, abstract, drawing figure, etc.) of this application, unless clearly specified to the contrary, such as via explicit definition, assertion, or argument, with respect to any claim, whether of this application and/or any claim of any application claiming priority hereto, and whether originally presented or otherwise:

there is no requirement for the inclusion of any particular described or illustrated characteristic, function, activity, or element, any particular sequence of activities, or any particular interrelationship of elements;

no characteristic, function, activity, or element is "essential";

any elements can be integrated, segregated, and/or duplicated;

any activity can be repeated, any activity can be performed by multiple entities, and/or any activity can be performed in multiple jurisdictions; and any activity or element can be specifically excluded, the sequence of activities can vary, and/or the interrelationship of elements can vary.

Moreover, when any number or range is described herein, unless clearly stated otherwise, that number or range is approximate. When any range is described herein, unless clearly stated otherwise, that range includes all values therein and all subranges therein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

When any claim element is followed by a drawing element number, that drawing element number is exemplary and non-limiting on claim scope. No claim of this application is intended to invoke paragraph six of 35 USC 112 unless the precise phrase "means for" is followed by a gerund.

Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such material is specifically not incorporated by reference herein.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

What is claimed is:

1. A shoelace tightening system, comprising:

a tightener, the tightener inset in a body of a shoe;

a hinge, the hinge coupled to the tightener;

an appendage, the appendage coupled to the tightener via the hinge, the appendage constructed to move in and out of the body of the shoe such that the appendage is inset in the body of the shoe, secured into place, and does not protrude from the body of the shoe when a user is not loosening or tightening a pair of shoelaces, wherein the appendage can protrude from the shoe when the appendage is not secured into place so that the user can use the appendage to:

engage the tightener which engages with each of the pair of shoelaces; and responsive to an action of the user, cause each of the pair of shoelaces to be loosened and tightened.

2. The shoelace tightening system of claim 1, wherein:

a securing mechanism for keeping the appendage from protruding from the shoe is a spring so that the appendage is biased to stay inside the body of the shoe, but the user can pull on the appendage to cause the appendage to protrude from the shoe so the user can use the appendage to operate the tightener.

3. The shoelace tightening system of claim 1, wherein:

a securing mechanism constructed to keep the appendage from protruding from the shoe comprises a magnet inset in the shoe that attracts a metal part of the appendage, the magnet has a strong enough magnetic field to keep the appendage in the shoe when the user is not loosening or tightening the shoe, but a weak enough magnetic field so that the user can easily pull the appendage out of a secured position to adjust tightness of the shoe.

4. The shoelace tightening system of claim 1, wherein:

the tightener is spring loaded such that the tightener tightens to a foot of the user when the user puts the shoe on.

5. The shoelace tightening system of claim 1, wherein:

the pair of shoelaces enters into the body of the shoe at a topmost eyelet and goes through a rear portion of the body of the shoe to reach the tightener.

6. The shoelace tightening system of claim 1, wherein:

the pair of shoelaces enters into the body of the shoe at a bottommost eyelet and goes through a side portion and a rear portion of the body of the shoe to reach the tightener.

7. The shoelace tightening system of claim 1, wherein:

the tightener is inset in a rear portion of the body, a centerline of the tightener at an elevation on the rear portion of the shoe that is above an uppermost portion of a sole of the shoe.

8. The shoelace tightening system of claim 1, wherein:

the tightener is inset in a lower portion of a rear portion of the body of the shoe, a centerline of the tightener at an elevation on the rear portion of the shoe that is in line with a sole of the shoe.

9. The shoelace tightening system of claim 1, wherein:

the tightener is inset in a side portion of the body of the shoe.

10. The shoelace tightening system of claim 1, wherein:

the tightener is inset in a front portion of the body of the shoe.

11. The shoelace tightening system of claim 1, wherein:

the tightener comprises an electrical actuator operable by the user to loosen and tighten each of the pair of shoelaces.

12. The shoelace tightening system of claim 1, wherein:

the tightener comprises a wheel to which the pair of shoelaces is coupled such that the pair of shoelaces wraps around the tightener when the user tightens the pair of shoelaces to and unwraps around the tightener when the user loosens the pair of shoelaces.

13. The shoelace tightening system of claim 1, wherein:

the appendage comprises a wheel constructed to be turned by the user to loosen and tighten each of the pair of shoelaces.

14. The shoelace tightening system of claim 1, wherein:

the appendage is coupled to a wheel, which is coupled to the tightener and engages the tightener when the appendage is engaged.

15. A shoelace tightening system, comprising:

a tightener that is not entirely inset in a body of a shoe;

a hinge, the hinge coupled to the tightener;

an appendage, the appendage coupled to the tightener via the hinge, the appendage constructed to protrude from the body of the shoe, even when the appendage is secured into place and snug against the shoe, the appendage operable by a user to:

engage the tightener which engages with each of a pair of shoelaces; and responsive to an action of the user, cause each of the pair of shoelaces to be loosened and tightened.

16. The shoelace tightening system of claim 15, wherein: the appendage is also always protruding from the body of the shoe.

* * * * *